United States Patent [19]

Hurn et al.

[11] Patent Number: 5,076,135

[45] Date of Patent: Dec. 31, 1991

[54] RAIL GUN BARREL WITH CIRCUMFERENTIALLY VARIABLE PRESTRESSING

[75] Inventors: Thomas W. Hurn; Richard L. Creedon, both of San Diego, Calif.

[73] Assignee: General Atomics, San Diego, Calif.

[21] Appl. No.: 473,325

[22] Filed: Feb. 1, 1990

[51] Int. Cl.[5] ..... F41B 6/00

[52] U.S. Cl. ..... 89/8; 89/16; 124/3

[58] Field of Search ..... 89/8, 16; 124/3

[56] References Cited

U.S. PATENT DOCUMENTS

| | | | |
|---|---|---|---|
| 1,421,435 | 7/1922 | Fauchon-Villeplee | 124/3 |
| 3,613,499 | 10/1971 | Hubbard et al. | 89/8 |
| 4,624,173 | 11/1986 | Creedon | 89/8 |
| 4,771,530 | 9/1988 | Creedon | 264/512 |
| 4,840,200 | 6/1989 | Creedon | 264/228 |
| 4,846,911 | 7/1989 | Tackett et al. | 89/8 |
| 4,884,489 | 12/1989 | Zowarka et al. | 89/8 |

FOREIGN PATENT DOCUMENTS

| | | | |
|---|---|---|---|
| 3971 | of 1914 | United Kingdom | 89/16 |
| 13552 | of 1915 | United Kingdom | 89/16 |
| 2187826 | 9/1987 | United Kingdom | 124/3 |

OTHER PUBLICATIONS

Patch et al, "Railgun Barrel Design and Analysis," IEEE Transactions on Magnetics, vol. MAG-20, No. 2, Mar. 1984, pp. 360–363.

*Primary Examiner*—Stephen C. Bentley

*Attorney, Agent, or Firm*—Fitch, Even, Tabin & Flannery

[57] ABSTRACT

A rail gun barrel has a pair of opposed spaced apart rails separated by a pair of opposed stepped insulator members, which cooperate to define an internal bore. Interior body members surround the bore-defining components and fill the space between those components and an outer surrounding containment tube of varying curvature. A pressure cavity is provided in the interior body members on at least one side of the bore to load the outer containment tube, which because of its varying curvature, translates a circumferentially variable prestress inversely proportional to its curvature and is selected to match the particular loading scenario.

6 Claims, 5 Drawing Sheets

RAIL GUN BARREL WITH CIRCUMFERENTIALLY VARIABLE PRESTRESSING

BACKGROUND OF THE INVENTION

The present invention pertains to barrel assemblies for use in electromagnetic rail guns.

DESCRIPTION OF THE RELATED ART

Various types of rail guns have been proposed for using electromagnetic forces to accelerate projectiles to a high velocity, and to direct the projectiles toward selected targets. Significant pressures are generated in the bore of a rail gun barrel during firing and adequate precautions must be taken to guard against bursting of the barrel. This pressure distribution originates from several sources which are dependent upon the type of armature deployed. These armatures can be of a solid material, a plasma, or a solid material which is transitioning to a plasma at the rail surface (called a hybrid armature).

In the case of solid armatures, the load distribution is only due to non-axisymmetric rail repulsion forces acting perpendicular to the rail surface. These forces act for the duration of the shot. The plasma armature loading has a force component, due to the plasma pressure behind the projectiles, which is of short length. This axisymmetric pressure moves with the projectile and therefore, acts at one location for a very short time span when compared to the rail repulsion loads. When these loads are combined, the resulting pressure distribution varies circumferentially across the barrel section. The hybrid armature has a rail repulsion component and a moving non-axisymmetric load due to plasma pressure between the rail surface and the armature.

In all of the above cases, the loading varies circumferentially. These loads are typically contained through prestressing the internal bore components in order to minimize or eliminate any detrimental bore opening during a shot. So-called "bolted barrel" designs have configured the prestress in a unidirectional manner over the rail surfaces, whereas "isostatic barrel" designs have provided an axisymmetric prestress. However, no barrel structure has been developed which allows the tailoring of the prestress circumferentially to match the loading. This capability, heretofore lacking, is provided with the present invention.

U.S. Pat. No. 4,624,173 discloses an elongated rail gun barrel comprised of several generally coextensive components. The barrel gun members were disposed within an outer shell and a pressurized medium was introduced between the shell and the members to apply a radially inwardly directed prestressed force.

While the rail gun barrel described in the U.S. Pat. No. 4,624,173 has provided significant advances over previous rail gun barrel designs and has been met with favorable acceptance, several improvements can be made. For example, development of the present invention has shown that the electromagnetic repulsion forces of the rails provide the dominant load component, even considering the rather large bursting pressures associated with firing of the rail gun. It has been found desirable in some applications to provided added strengthening of the rail gun barrel without an excessive enlargement of the barrel size.

In certain applications, particularly those associated with the testing of a rail gun system, it has been found desirable to routinely disassemble prototype barrels to evaluate the performance of the various internal components thereof.

In other applications it has been found desirable to conduct tests on rail gun barrels which have a wide variety of prestressing arrangements. In particular, it has been found desirable to provide rail gun barrels which may be prestressed either permanently or intermittently so that long term performance under differing conditions can be evaluated.

SUMMARY OF THE INVENTION

It is an object of the present invention to provide a rail gun barrel with circumferentially variable prestressing.

Another object according to the present invention is to provide a rail gun barrel which can be prestressed through a variety of different pressure media.

A further object according to the present invention is to provide a rail gun barrel which can be prestressed either permanently or intermittently.

These and other objects according to the present invention, which will become apparent from studying the following description and appended drawings is provided in a rail gun barrel apparatus having a longitudinal axis and defining an internal bore extending along said axis, comprising:

a pair of opposed, double-sided rails on opposed sides of the bore, spaced-apart along a preselected direction lying in a cross-sectional plane transverse to said longitudinal axis;

a pair of opposed inner insulator members extending between said rails so as to define said bore;

an outer containment tube of variable curvature surrounding the inner insulator members and the rails;

internal body means disposed within said outer containment tube; and pressure means for applying pressure in said preselected direction to load the outer containment tube so as to prestress the internal body means with a circumferentially variable prestress which is inversely proportional to the containment tube curvature.

Other objects according to the present invention are attained in other rail gun embodiments, having a number of different pressure means. For example, a solid rubber block can be inserted in the pressure cavity and a compressive force can be applied to the block to prestress the rail gun components. Alternatively, a liquid such as an hydraulic oil can fill the cavity and be compressed to relatively high pressures. If reusability of the rail gun barrel is not important for a particular application, a liquid/solid phase change material can be injected into the pressure cavity at high pressures, and its phase state transformed while under pressure to a solid.

Other objects of the present invention are attained in rail gun barrels having round cross-sections as well as rail gun barrels having elongated cross-sections, preferably elongated in directions transverse to the rail means.

Further objects according to the present invention are attained in rail gun barrels wherein the pressure means surrounds the body means, the pressure means being separated into separate, independent portions about the barrel cross-section, to provide a circumferentially variable prestress. Preferably, a pair of portions are aligned with the rails and provide a major prestress component in a direction passing through the rails. Auxiliary portions developing a lesser prestress can be provided, aligned with those body members extending between the rails which contribute to form the rail gun bore.

BRIEF DESCRIPTION OF THE DRAWINGS

In the drawings, wherein like elements are referenced alike.

DETAILED DESCRIPTION OF THE PREFERRED EMBODIMENTS

Figure 1:
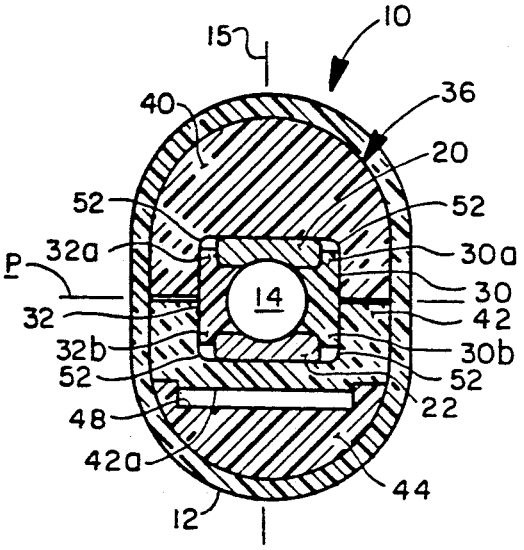
FIG. 1 is a cross-sectional elevational view of a rail gun barrel for use with a solid armature, illustrating aspects according to the present invention.

Referring now to the drawings, and initially to FIG. 1, a rail gun barrel is generally indicated at 10. Barrel 10 includes an outer containment tube preferably formed of a lightweight, electrically insulating medium such as a filament wound construction wherein fiberglass filaments are imbedded in an epoxy resin matrix. Alternatively, the containment tube 12 can be formed of a graphite-epoxy composition. As a less preferable alternative, the containment tube 12 can be formed of a metal, metal alloy or metal-containing material.

As will be seen herein, significant pressure forces are generated within the bore of the rail gun barrel 10, forces which tend to burst the barrel construction. In order to successfully contain these bursting forces, the barrel is prestressed with inwardly directed prestressed forces. In each of the various embodiments, these forces vary circumferentially and are inversely proportional to the local radius of the containment tube.

Disposed at the center of rail gun barrel 10 is a bore 14 for receiving a projectile and for confining the projecting forces behind the projectile. The bore 14 in FIG. 1 has a circular cross-sectional but as will be seen in FIG. 4, for example, the bore can have other cross-sectional configurations as might be desired for various reasons, and rail gun barrels embodying principles according to the present invention can accommodate virtually any bore configuration that may be desired.

In one embodiment of the present invention, the bore of the rail gun barrel is characterized by a plurality of interlocking members. The preferred number of the bore-defining members is four, although those skilled in the art will readily appreciate that the principles according to the present invention also encompass different numbers of bore defining members. Also, according to another aspect of the present invention, the four bore-defining members are arranged in opposed pairs so that, traversing the bore in a cross-sectional plane, the bore-defining members are comprised of alternating electrically conducting and electrically insulating materials.

The conducting members are arranged in an opposed pair, on opposite sides of bore 14, and are spaced apart along a cross-sectional axis 15. The electrically conducting members, commonly termed "rails" are made to carry electrical currents from one end of the rail gun barrel to the other so as to generate electromagnetic fields that travel along the rail gun barrel, generating electromagnetic forces within bore 14 that drive the projectile along the barrel, and beyond. According to one feature of the present invention, the rails, designated herein by the reference numerals 20, 22 have a generally rectangular cross-sectional configuration which is elongated in a generally horizontal direction. The rails 20, 22 may be made of any suitable conductive material such as a copper alloy. As can be seen in the various figures, the rails are rounded at the outer corners where the minor sidewalls meet the major surfaces of the rail. As mentioned, the rails are energized with a relatively high voltage during firing of a projectile and the rounded corners of the rails help eliminate electrical stress which might result in an arcing and also reduce the amount of current peaking at these locations.

As mentioned, preferably four bore-defining components surround the rail gun bore 14. Disposed between rails 20, 22 is a pair of opposed inner or central insulator body members 30, 32. According to one aspect of the present invention, the central insulators 30, 32 have stepped edges at their ends 30*a*, 30*b* and 32*a*, 32*b*, respectively. The stepped ends of the central insulators receive laterally opposed sides of the rails 20, 22 so as to provide an interlocking engagement therewith. The central insulators 30, 32 are rounded at their opposed, inner faces so as to define a portion of the cylindrical bore 14. Due to the cross-sectional configuration of rails 20, 22 and the distance between the rails, the central insulators 30, 32 together form a major portion of the bore wall. This requires that only minor portions of the opposed major surfaces of the rectangular rails be removed to conform to the cylindrical bore 14. This simplifies machining of the rails and provides a maximum amount of conductive material for the rail, while allowing the rail to partially define the cylindrical bore.

In other cases where the current density between the armature and rail should be minimized to reduce bore erosion, the rail gun barrel can be reconfigured such that the rail surface is maximized in the bore. As will be appreciated by those skilled in the art, the rails 20, 22 can be employed to define a cylindrical bore using readily available metal bar material and requiring only minimal amounts of machining or extrusion to produce the finished rails. Thus, no bending or curved distortion of the metal bars or other stock from which the rails are formed, is required.

The central insulators 30, 32 are preferably made of a suitable insulator material such as the glass fiber-melamine composite commonly referred to as "G-9", a term referring to a well known standard established by NEMA. As will be appreciated by those skilled in the art, the G-9 material can be readily machined to produce the bore-defining wall face and the stepped ends which produce the desirable interlocking with the rails 20, 22.

Referring again to FIG. 1, the space between the containment tube 12 and the rails 20, 22 as well as insulators 30, 32 is filled with an interior body structure generally indicated at 36, which is preferably comprised of a plurality of mating interior body members. In the preferred embodiment, assembly 36 is formed of an upper interior body member 40, an intermediate interior body member 42 and a lower interior body member 44. According to one aspect of the present invention, the interior body members 40–44 completely fill the space between the rails 20, 22, the central insulators 30, 32 and the outer containment tube 12, except for a pressure cavity 48. Each of the interior bodies 40, 42 and 44 may have a monolithic construction but, as will be seen with reference to FIG. 7, they may be formed of a serial array of plates or laminations stacked one against the other along the length of barrel 10.

In the embodiment illustrated in FIG. 1, the internal body members 40–44 are made of an electrically insulating material such as a fiberglass-filled epoxy resin (G-10). Other electrical insulating materials may also be used, particularly those which are suitable for forming laminations. As will be seen with reference to FIG. 2, the internal body members may also be made of an electrically conductive material, although such is less preferred.

The body members 40, 42 are brought close together at opposed mating faces which, according to one aspect of the present invention, lie in a generally horizontal plane P intersecting the center of bore 14. The interior body members 42, 44 may be initially butted together during construction, but there will be a slight gap therebetween when the barrel is preloaded. The interior body members are brought together at mating faces which also extend in a generally horizontal direction. The lower interior body member 44 is recessed at its upper, mating surface so as to form the pressure cavity 48 when butted against the intermediate interior body member 42. The fit between 42 and 44 will be such to contain the pressure medium or external sealing means utilized.

In this embodiment of the present invention, the interior body members 40–44, when mated together, form an assembly whose cross-section is elongated in a generally vertical direction along axis 15, that is, in the same direction in which the rails 20, 22 are spaced apart. The pressure cavity 48 of this embodiment has a cross-section which is elongated in a generally horizontal direction, that is, in a direction generally perpendicular to the direction of cross-sectional elongation of the interior body assembly 36. Pressures generated within cavity 48 therefore exhibit a directionality which forces the rails 20, 22 toward one another. As will be seen in FIGS. 5 and 6, pressure cavities of different cross-sectional configurations can also be used. In general, the circumferentially varying pressures developed within the pressure cavities of rail gun barrels constructed according to principles of the present invention, provide the desired circumferentially variable prestressing of the bore-defining rails and central insulators through the shape of the confinement tube.

As will now become apparent, the pressure cavity formed in the interior of the rail gun barrel can be provided in a variety of ways. For example, it has been found convenient to provide separate interior body members 42, 44. If desired, however, the body members 42, 44 can be combined in either a laminated or monolithic structure with apertures in the laminations forming the pressure cavity, or if constructed in a monolithic fashion, a bore can be formed through the lower monolithic body member, using conventional techniques.

As pressure is developed in cavity 48, a load path is established through the rails and insulators to preload the bore. As mentioned, there is a slight gap between the interior body members 40, 42. The radially inward prestress from the containment tube pushes the rails and insulators radially inwardly and tightens the interlocking arrangement thereof. As in other embodiments of the present invention, the stresses in the outer containment tube and the prestressed forces applied to the bore-defining members are not radially uniform, but rather are circumferentially variable to provide a number of advantages which will become apparent from the following discussion.

The elongation and directions of elongation of the various components of this embodiment of the rail gun barrel play an important role in achieving the circumferentially variable prestress with minimum weight and expense. Practical rail gun barrels must contain the bursting pressures associated with firing of a projectile. These pressures range between 25,000 and 100,000 psi. While those familiar with electrical devices might recognize that repulsion forces tending to drive the rails apart would be present due to the electrical currents carried therein, the magnitude of the repulsion forces has previously been thought to be negligible compared to the bursting pressures caused by the plasma. However, it has been found that the directionally oriented repulsion forces are capable, especially over a period of time, to distort conventional rail gun barrel geometries. In addition to the radially non-uniform loading caused by repulsion of the rails an axisymmetric pressure load is caused by a plasma-fired projectile. Certain permanent distortions have been observed for conventional rail gun barrels operated under defined conditions. A study was conducted to examine in greater detail the forces experienced by rail gun barrel components. Particular attention was paid to the pressure loads associated with plasma armatures, which are exerted locally behind a travelling projectile, typically over a distance of approximately 10 bore diameters, and act at a particular location for relatively short durations, on the order of 100 microseconds. The pressure loads associated with plasma armatures have been confirmed to be axisymmetric and the stresses associated therewith have been found to be significantly less than those stresses caused by the rail repulsion.

Attention was then directed to a more detailed study of the rail repulsion forces to determine their effect on conventional rail gun barrel constructions, such as the construction described in commonly assigned U.S. Pat. No. 4,624,173. The isostatic rail gun barrel described in the United States patent consists of four elements, alternating electrically conductive rails and electrical insulators which, when pressed together, form a uniform outer cylindrical surface. One rail gun barrel described in the patent preferably consists of multiple bores with resin fluidically injected between the bore-defining components and an outer casing. The resin applies an isostatic prestress to the several bore-defining arrangements. When operated under certain conditions, the isostatically prestressed rail gun barrel was found to exhibit irreversible ovalization of the rail gun bore. When repeatedly operated at certain loading values, the rail-to-rail dimension of the bore was found to increase, while the bore-defining insulator-to-insulator dimension was found to decrease. The ovalization was found, at times, to be nonlinear along the length of the rail gun barrel, because of the non-uniform distributions along the length which are typical in rail guns.

Further study indicated that, due to the construction of the bore-defining components and the manner of prestressing those components, rail repulsion forces were found to be partially resolved in increased compression forces on the bore-defining insulator members. The geometry of the mating faces of the bore-defining components were observed to retain the incremental displacement associated with a particular "shot" or projectile firing event. The retention of these distorting displacements was experienced as a wedging effect at the rail-to-insulator interface and, due to the relatively high level of prestressed forces, the wedging was associated with very high frictional forces, thus, the distortion retention was found to result in an irreversible ovalization. Changes to the relative geometries of the radially segmented rail and insulator bore-defining components could be made and reinforcements to contain the rail repulsion forces could also be added to the arrangement described in U.S. Pat. No. 4,624,173 but such would inevitably lead to a rail gun barrel of increased size and cost.

The various features of this first embodiment of a rail gun barrel constructed according to principles of the present invention, wherein the interior body is elongated in the direction of spacing between the rails and a pressure chamber is provided along the axis of elongation of the interior body and which may be elongated in a direction transverse to that axis of elongation, provides prestressing on the bore-defining components which is circumferentially variable, that is, is non-uniform in radial directions taken from the bore center. When the pressure cavity is pressurized in a manner to be described herein, a significantly greater prestress force is applied along the axis 15 of cross-sectional elongation, than along an axis in plane P, generally normal thereto. Because the radial force exerted on the bore-defining components is inversely proportional to the curvature of the containment tube, the prestress force can be given a directional characteristic which can be carefully controlled throughout the life of the barrel. Containment tubes for solid armature rail gun barrels have what is generally termed a "race track" configuration, with semicircular ends separated by parallel wall surfaces. Containment tubes for plasma armature applications, however, require a curvature on the minor radius of the outer containment tube 12. A containment tube of this latter type will be discussed below with respect to FIG. 10. Other embodiments of the present invention employ a cylindrical tube, and also exhibit radially non-uniform prestressing pressures.

With a rail gun barrel embodying principles of the present invention the pressure forces created in the pressure cavity are more efficiently utilized and are intensified in directions where needed the most. Further, a rail gun barrel constructed according to principles of the present invention develops the prestress pressure on the various internal components thereof with the minimum necessary shear stress, particularly at the mating boundaries. This is important when using composite materials because typically their use is limited to their maximum allowable interlaminar shear stress.

For example, the upper interior body member 40 of the first embodiment is interlockingly engaged with the upper rail 20 and upper portions of the central insulators 30, 32. The prestress pressure is developed generally perpendicular to the mating faces of the upper interior member 40 and the upper rail 20. The inwardly directed prestress pressure on upper rail 20 is resolved in the upper stepped portion **30*a*, 32*a* of the central insulators 30, 32. This prestress pressure is developed across the major surfaces of rail 20** which results in a maximally stable configuration, which is highly resistant to distortion when placed under load.

Further, the radially uniform plasma pressure experienced during firing of a projectile is resolved at the major mating surfaces of the upper interior body member 40 and rail 20 in the manner described above for the prestress forces. Additionally, the bursting pressures associated during firing of the rail gun cause the flat outer surfaces of the central insulators 30, 32 to press against the flat, internal surfaces of the upper and intermediate interior body members 40, 42 which are preloaded by providing adequate curvature of the containment tube, thereby exhibiting a stability against dislocations. Due to the overlapping of the outer surfaces of the bore-defining members, that is, the interlocked engagement between rails 20, 22 and central insulators 30, 32, components of the bursting pressures which lie "off-axis" i.e., in directions either along the axis of elongation of the barrel cross-section or the axis transverse thereto, are resolved at the major surfaces of the bore-defining components without developing dislocations of those components. By minimizing the prestress along axis P, the shearing force on the insulator is minimized, thereby allowing for minimal radial build in this direction.

Pressure developed at the mating surfaces of the central insulators 30, 32 and the lateral sides of the upper and intermediate interior body portions is resolved at the straight line portions of the containment tube cross-section. Bursting pressures directed along the axis 15 of cross-section elongation, developed at the mating faces of the rails and the upper and lower interior body members are resolved at the rounded top and bottom portions of the containment tube 12. Thus, the containment tube used in the present invention has appropriate curvatures to match the loads developed at the bore-defining components.

Figure 2:
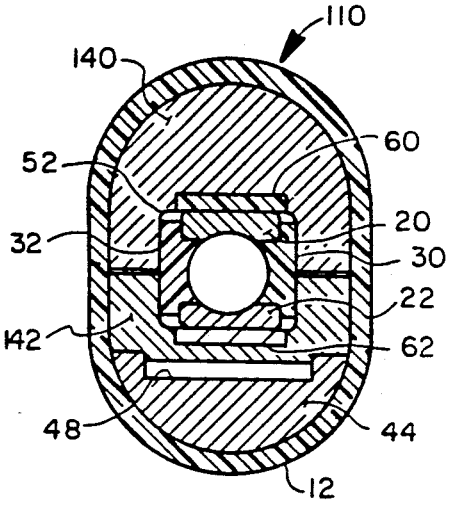
FIG. 2 is a cross-sectional view of a rail gun barrel similar to that of FIG. 1, but having a conductive interior body.
Figure 3:
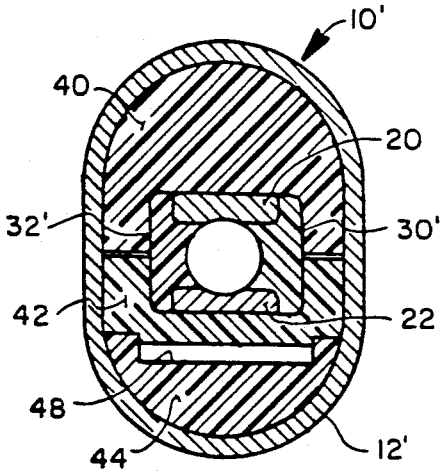
FIG. 3 is a cross-sectional view of a rail gun barrel similar to that of FIG. 1, but having an alternative arrangement of bore-defining inter-rail body members.

In the embodiments of FIGS. 1 and 2, the stepped ends of the central insulators 20, 22 do not extend fully to meet the surrounding interior body members. Accordingly, air gaps 52 are present at the outer corners of the rails. Referring now to FIG. 3, the central insulators 30', 32' have stepped ends which meet the upper and lower interior body members 40, 44, thus eliminating the air gaps 52. The rail gun barrel 10' of FIG. 3 is otherwise identical to the rail gun barrel 10 illustrated in FIG. 1.

In a further effort to eliminate shear stress in the rail gun barrel 10, the pressure cavity 48 is formed by a notch in the upper surface of the lower interior body member 44. The cavity is enclosed by the downwardly facing mating surface 42a of intermediate interior body member 42. Thus, horizontally directed components of the pressure developed in cavity 48 are resolved at the ends of lower body member 44, and are not developed at the mating faces of interior body member 42 and the lower body member 44, thus eliminating shear forces and the possibility of dislocations when the rail gun barrel is placed under load.

As will be seen herein, interlocking of the body members and rails is preferred, but can be omitted if desired.

Referring now to FIG. 2, an alternative embodiment of the rail gun barrel is indicated generally at 110. Barrel 110 is substantially identical to barrel 10 illustrated in FIG. 1 except that the interior body members 140, 142 and 144 are formed of a non-insulating material, such as graphite-epoxy laminations or a monolithic graphite-epoxy construction. To prevent an electrical shorting or low resistance path between the rails 20, 22, electrically insulating backing plates 60, 62 are provided at the outer major surfaces of rails 20, 22, insulating the rails from their adjacent interior body members. The backing plates 60, 62 are preferably formed of G-9 or G-10 material or other suitable electrical insulator material.

Preferably, the backing plates 60, 62 extend slightly beyond the major surfaces of the rails which they contact. The backing plates 60, 62 preferably have a generally rectangular cross-section, which is elongated in a generally horizontal direction so as to present a major mating surface to the major mating surface of the rail which they contact. The rectangular cross-section of the backing plates is preferred, to provide an interlocking engagement with the interior body members which receive the backing plates. Thus, shear stress is eliminated at the mating surfaces of the backing plates and rails and also at the interface of the backing plates and the interior body members, thus preventing dislocation of the backing plates. Other features of the rail gun barrel remain the same as those described above with reference to FIG. 1.

Figure 4:
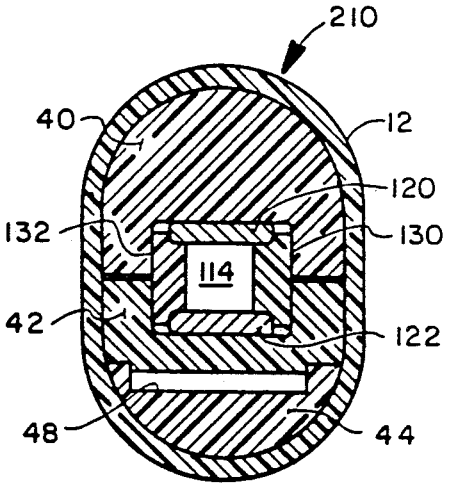
FIG. 4 is a cross-sectional view of a rail gun barrel having a generally rectangular bore.

Turning now to FIG. 4, a further alternative embodiment of a rail gun barrel embodying principles of the present invention is generally indicated at 210. The rail gun barrel 210 is substantially identical to the rail gun barrel 10 described above with reference to FIG. 1, except for the rectangular and preferably square-shaped bore 114 formed at the center thereof. The rails 120, 122 are substantially identical to the rails 20, 22 except that the slight depressions at their inner surfaces are no longer required to meet the desired configuration of the bore. The central insulators 130, 132 have outer major surfaces and stepped ends as described above with reference to FIG. 1, but differ from the central insulators 30, 32 in that the opposed interfaces thereof are generally flat. Other features of the rail gun barrel 210 are identical to those described above with reference to FIG. 1.

One advantage of a rail gun barrel constructed according to principles of the present invention, is that the barrel can be intermittently prestressed, and can therefore be easily and rapidly reconfigured to have bores of circular cross-section or square cross-section, by simply interchanging the four bore-defining components. Thus, it is not necessary to reconstruct the interior body members or to reconfigure the pressure cavity 48. Further, bores having other cross-sectional configurations other than those described herein can also be readily provided for rail gun barrels constructed according to the present invention.

Figure 5:
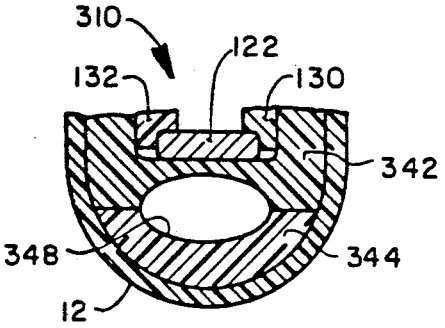
FIG. 5 is a fragmentary cross-sectional elevational view similar to that of FIG. 4 but showing an alternative embodiment of a pressure cavity.

Turning now to FIG. 5, an alternative embodiment of a rail gun barrel is generally indicated at 310. The barrel 310 is substantially identical to the barrel 210 described above with reference to FIG. 4, except that barrel 310 has a pressure chamber 348 of generally oval cross-sectional configuration. The rail gun barrel 310 has intermediate and lower interior body members 342, 344 which are substantially identical to the body members described above, except for the semi-oval recesses formed therein which form the pressure cavity 348 when the interior members are mated together. Portions of the pressure cavity 348 extend into both interior body members 342, 344 but the shear stress formed at those mating faces is reduced because of the orientation of the major axis of the oval to the mating faces of the interior body members. For reasons of elimination of the shear stress and the development of maximal prestressed pressure in the direction of cross-sectional elongation, and the ease of sealing the pressure cavity, the generally rectangular pressure cavity 48 described above is preferred. However, the oval cross-section cavity 348 may also be employed successfully.

Figure 6:
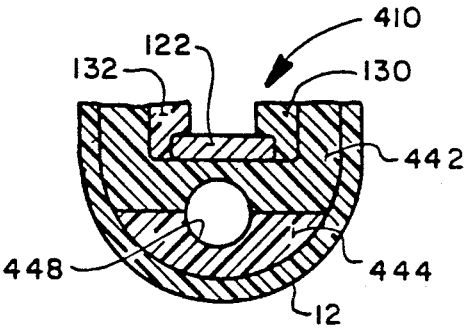
FIG. 6 is a fragmentary cross-sectional view of a rail gun barrel similar to that of FIG. 5, but showing a further alternative embodiment of a pressure cavity.

Referring now to FIG. 6, a further alternative embodiment of a rail gun barrel is generally indicated at 410. The barrels 310 and 410 are substantially identical, except that the pressure cavity 448 of barrel 410 is generally circular in cross-section. The interior body members 442, 444 are substantially identical to those described above, except for the semi-cylindrical recesses formed therein.

Figure 7:
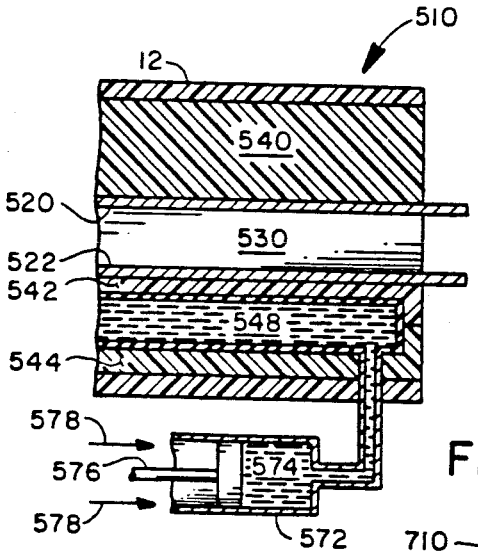
FIG. 7 is a fragmentary cross-sectional view taken along a longitudinal axis of a rail gun barrel, showing one end of the barrel and hydraulic pressure means for generating pressure in the pressure cavity of the barrel.
Figure 8:
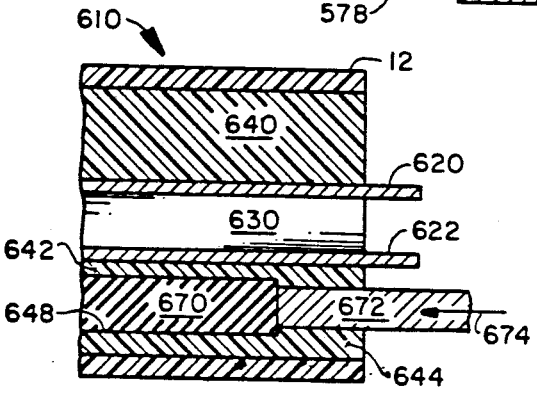
FIG. 8 is a cross-sectional view similar to that of FIG. 7 but showing a rubber slab in the pressure cavity of the rail gun barrel compressed by a plunger.
Figure 9:
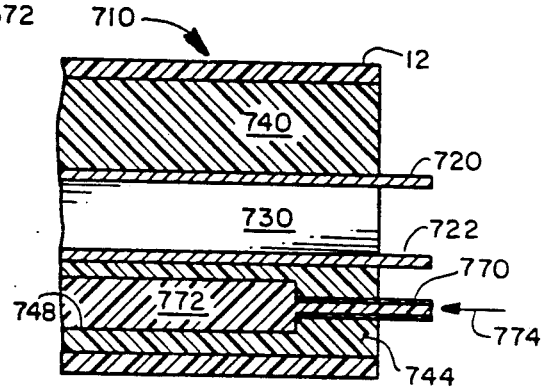
FIG. 9 is a cross-sectional view of a rail gun barrel similar to that of FIGS. 7 and 8 but showing an epoxy resin pressure medium fluidically injected in the pressure cavity and allowed to cure.

Referring now to FIGS. 7–9, cross-sectional views of rail gun barrels 510, 610 and 710, respectively will be described. The cross-sections of these rail gun barrels are taken in directions generally transverse to the cross-sections of FIGS. 1–6, that is, in a generally vertical plane extending along the length of the rail gun barrel. Upper and lower rails 520, 522 are separated by central insulators 530. Interior body members 540, 542 and 544 surround the bore-defining members in the manner described above. A pressure cavity 548 extends along the length of barrel 510. The vertical height of cavity 548 is exaggerated in FIG. 7 for clarity of illustration. If desired, this cavity may be contained through the use of a bladder made of rubber or metal. A passageway 570 joins the pressure cavity 548 to a cylinder 572 filled with a hydraulic pressure fluid 574. A piston 576 is driven in the direction of arrows 578 to produce a prestressing pressure in cavity 548. After a test firing, or whenever the interior components of rail gun barrel 510 are to be examined, the piston 576 can be moved in directions opposite to arrows 578 so as to relieve pressure in cavity 548 thereby facilitating rapid disassembly of the rail gun barrel.

Turning now to FIG. 8, an alternative embodiment of a rail gun barrel is generally indicated at 610. The interior body members 640, 642 and 644 are shown having an alternative monolithic construction. Rails 620, 622 are separated by central insulators 630. A pressure cavity 648 is illustrated with an exaggerated vertical height for purposes of clarity. A solid rubber block 670 is inserted in cavity 648 and a piston 672 is driven in the direction of arrow 674 to compress the rubber block 670 thereby creating the requisite prestressed pressure in cavity 648. The outer surface of block 670 may be lubricated with a suitable oil or grease so as to facilitate the uniform distribution of axial pressure applied to the end of block 670 by piston 672, and to provide a rapid relaxation of pressure after a firing event.

Referring now to FIG. 9, an alternative embodiment of a rail gun barrel is generally indicated at 710. Barrel 710 has monolithic interior body portions 740, 742 and 744. Rails 720, 722 are spaced apart by central insulators 740. A cavity which includes a bladder 748 for developing pressure within the rail gun barrel 710 is illustrated with an exaggerated vertical height for purposes of clarity. A passageway 770, preferably in the form of a filler tube provides communication with the interior of cavity 748. A resin material 772 is injected through tube 770 in the direction of arrow 774, so as to fill cavity 748, pressurizing the internal components of the rail gun barrel to a desired prestressed level. Upon curing of resin 772, rail gun barrel 710 is provided with a solid prestressed medium which will not leak or migrate.

Figure 10:
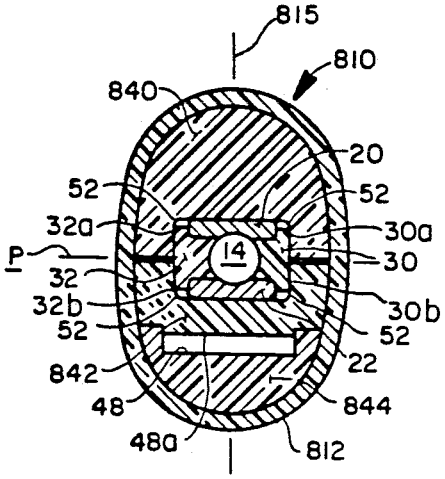
FIG. 10 is a cross-sectional elevational view of another rail gun barrel for use with a plasma armature, illustrating aspects according to the present invention.

Referring now to FIG. 10, a rail gun barrel is generally indicated at 810. The barrel is substantially identical to the barrel 10 described above with reference to FIG. 1, except that the outer containment tube has outwardly curved sidewalls. Whereas the barrel 10 accommodates solid armatures, the barrel 810 is adapted for use with plasma armatures. The body members 840, 842, 844 are identical to the body members 40, 42, 44 except for their convex side surfaces, conforming to the curved sidewalls of the containment tube. Operation and stress distribution of barrel 810 is substantially the same as that set forth above with respect to FIG. 1.

Figure 11:
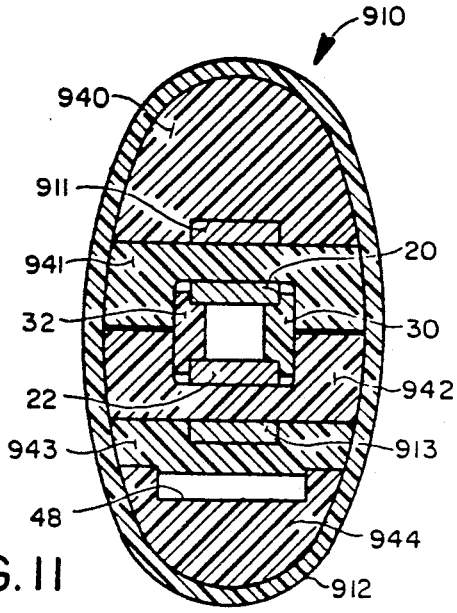
FIG. 11 is a cross-sectional elevational view of another rail gun barrel having an augmentation winding.

Referring now to FIG. 11, an augmented rail gun barrel is generally indicated at 910. The barrel is similar in many respects to the barrel shown in FIG. 10. For example, the barrel 910 has an "ovaloid" cross section for use with plasma armatures, and the interlocking rail and insulator structures are the same as those described above in FIGS. 1 and 10. The principle difference over FIG. 10 is that barrel 910 has an augmenting turn provided by conductors 911, 913. The augmenting turn carries current during a shot, so as to provide a magnetic field in addition to the field generated by current in the rails 20, 22, to increase the accelerating force on the projectile. The arrangement can produce the same acceleration as a non-augmented barrel, but with a lower rail current. To accommodate the upper conductor 911, the interior body member 840 of FIG. 10 is split into interior body members 940, 941. Similarly, the body member 842 of FIG. 10 is split into body members 942, 943. The body members 940, 941 are butted together, as are the body members 942, 943 and the body members 943, 944. As mentioned, the outer containment tube 912 is "ovalized" at both major and minor cross sectional axes of the barrel. The construction and operation of the barrel 910 is otherwise substantially identical to the rail gun barrel 10, for example.

Figure 12:
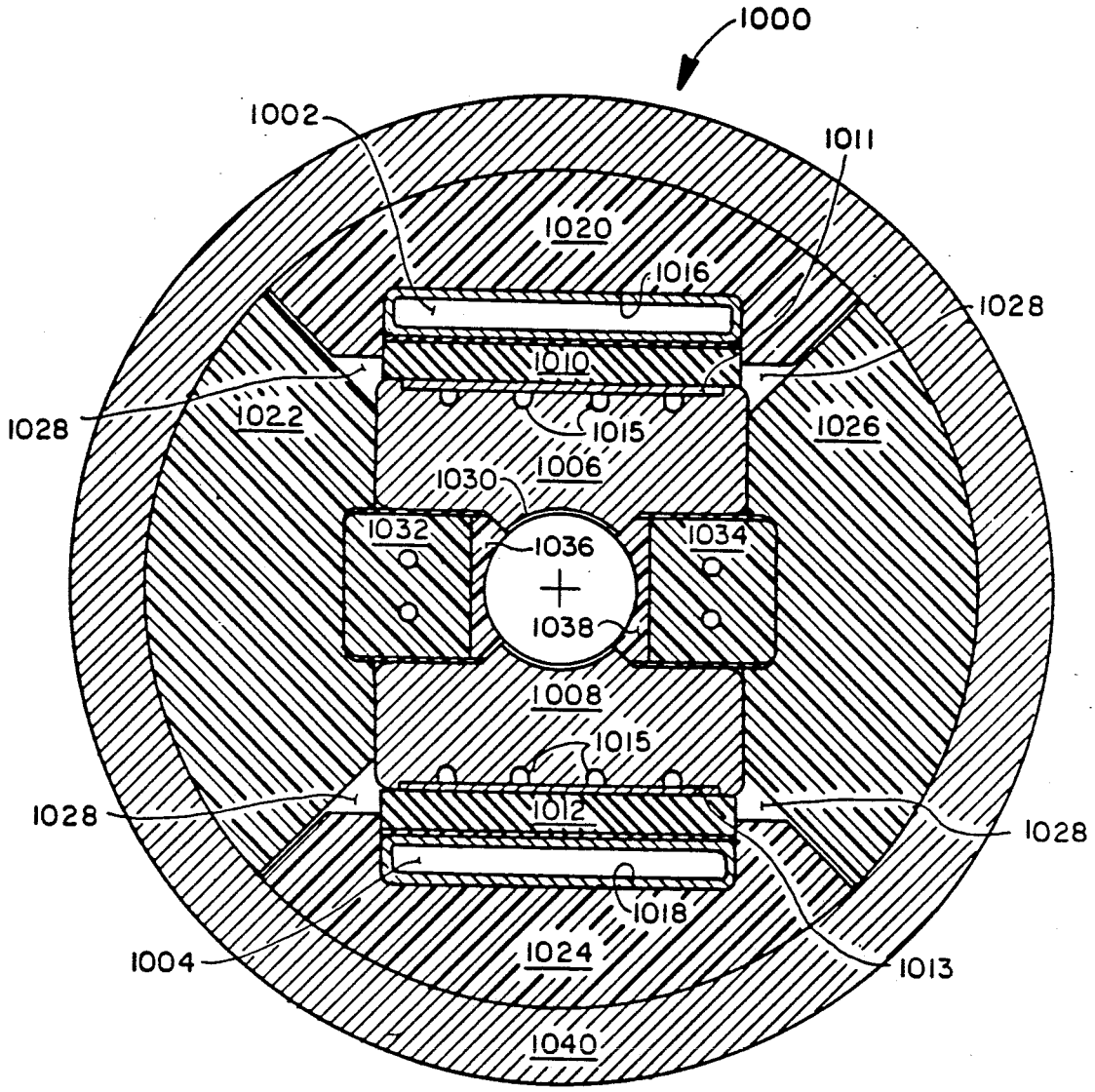
FIG. 12 is a cross-sectional elevation view of another embodiment of a rail gun barrel illustrating principles according to the present invention.

The above rail gun barrel had been described as employing a single pressure cavity, although two or more pressure cavities could also be employed according to the present invention. Referring to FIG. 12, for example, a rail gun barrel 1000 employs a pair of opposed pressure cavities 1002, 1004 disposed adjacent rails 1006, 1008. Dielectric blocks 1010, 1012 are employed to uniformly disperse pressure from the cavities 1002, 1004 to their associated rail members. The rail members 1010, 1012 include plates 1011, 1013 enclosing longitudinally extending grooves 1015 which may be employed for cooling the rails.

In this embodiment, the pressure cavities receive resilient bladders 1016, 1018 which are filled with any suitable pressurized fluid, such as hydraulic oil. Four body members 1020–1026 are disposed in quadrature about the rails 1006, 1008 respectively. As can be seen in FIG. 12, the insulator body members mate along diagonal or radial lines. The body members 1020, 1024 disposed adjacent the rails form voids 1028 with adjacent rail members.

As in previous embodiments, the rails of barrel 1000 form part of the internal bore 1030 of the rail gun barrel. Remaining portions of internal bore 1030 are formed by internal body members 1032, 1034 diametrically opposing one another, being positioned between the rails 1006, 1008. In this preferred embodiment, dielectric extension pieces 1036, 1038, are added to the internal body members 1032, 1034 to simplify the machining thereof.

Operation of the rail gun barrel 1000 is substantially identical to the barrels described above except that both opposed pressure cavities are pressurized at the same time, one contributing to the pressure exerted on the rails by the other. In the embodiment illustrated in FIG. 12, the pressure cavities are disposed diametrically opposite one another and the pressure cavities are not radially uniform throughout the barrel cross-section. The pressure cavites apply a circumferentially variable prestress inversely proportional to the containment tube curvature, the pressure being developed against the outer containment tube 1040.

Figure 13:
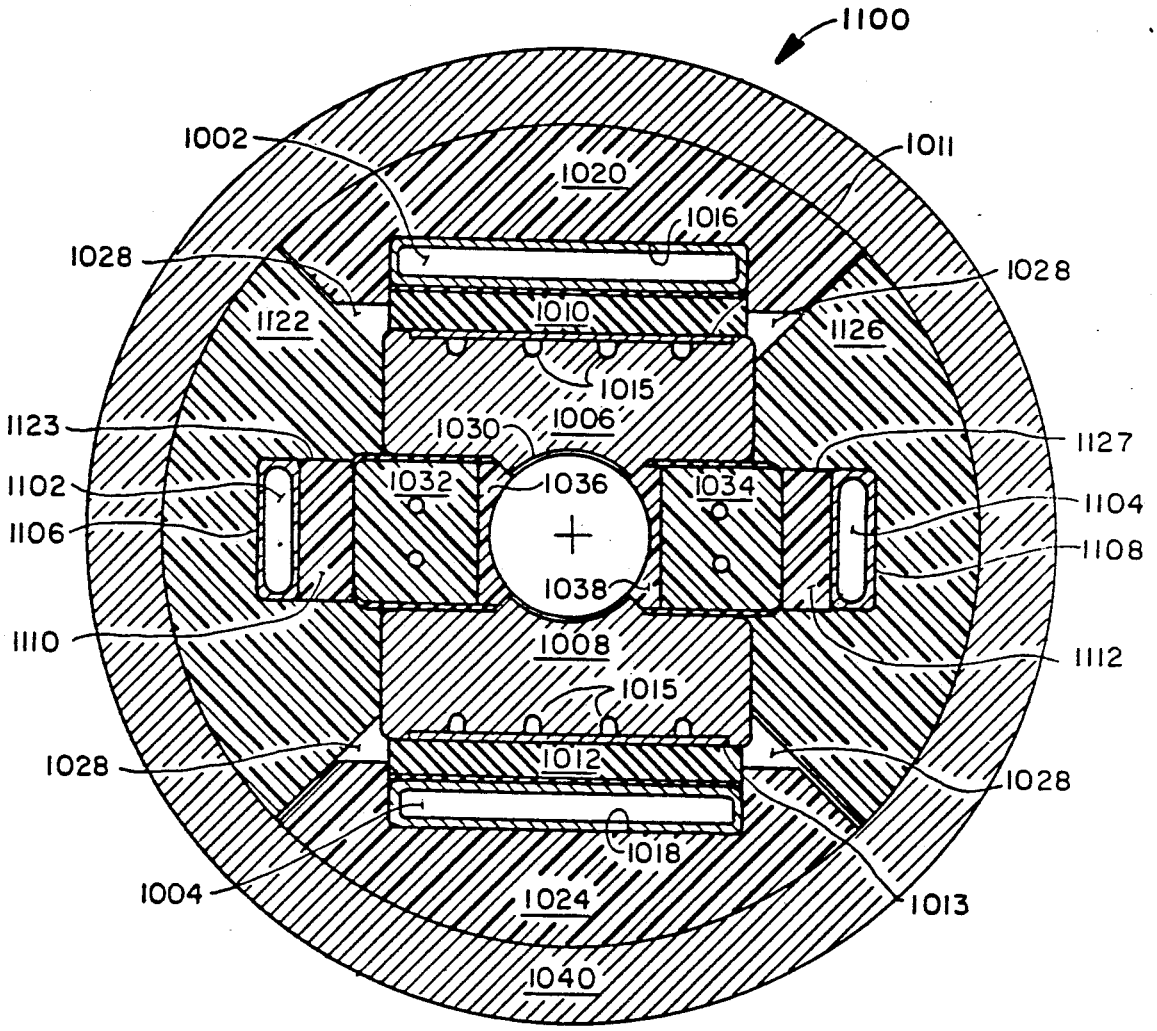
FIG. 13 is a cross-sectional elevation view of a further rail gun embodiment, similar to the rail gun barrel of FIG. 12, but having additional pressure means on each side of the rails.

Turning now to FIG. 13, rail gun barrel 1100 is substantially identical to the rail gun barrel 1000 of FIG. 12, except that a second pair of pressure cavities are employed, and are displaced generally orthogonally to the pressure cavities 1016, 1018. The auxiliary pressure cavities 1102, 1104 receive resilient bladders 1106, 1108, respectively. The bladders are filled with a suitable pressurized fluid, such as hydraulic oil. Dielectric blocks 1110, 1112 aid in uniformally distributing pressure to the internal body members 1032, 1034.

The lateral body members 1122, 1126 are substantially identical to the dielectric body members 1022, 1026 respectively, except for the longitudinal recesses 1123, 1127, for receiving the auxiliary pressure cavities, and the resilient bladders and pressure blocks received therein. It is important to note that the auxiliary pressure cavities 1102 and 1104 are substantially smaller than the main pressure cavities 1002, 1004 which are displaced 90° therefrom, and which supply the majority of pressure to the rail members. The smaller auxiliary pressure cavities 1102, 1104 have their major pressure components aligned with the inner body members 1032, 1034. Both pairs of pressure cavities apply a circumferentially variable prestress to the internal barrel components. If desired, the pressure cavities 1002, 1004 can be operated at different pressures from that of the auxiliary pair of pressure cavities 1102, 1104.

The rail gun barrels of FIGS. 12 and 13 employ body members which are mated along diagonal or radial lines, the mating edges of the body members not being stepped for interlocking engagement as in the preceding embodiments. If desired, the stepped inter-engagement could be added thereto, but such has not been found to be necessary for most applications. Further, it should be noted that the rail gun barrels illustrated in FIGS. 12 and 13 have generally circular outer cross-sectional peripheries, a circumferentially variable prestress having been provided without employing elongated cross-sections.

Figure 14:
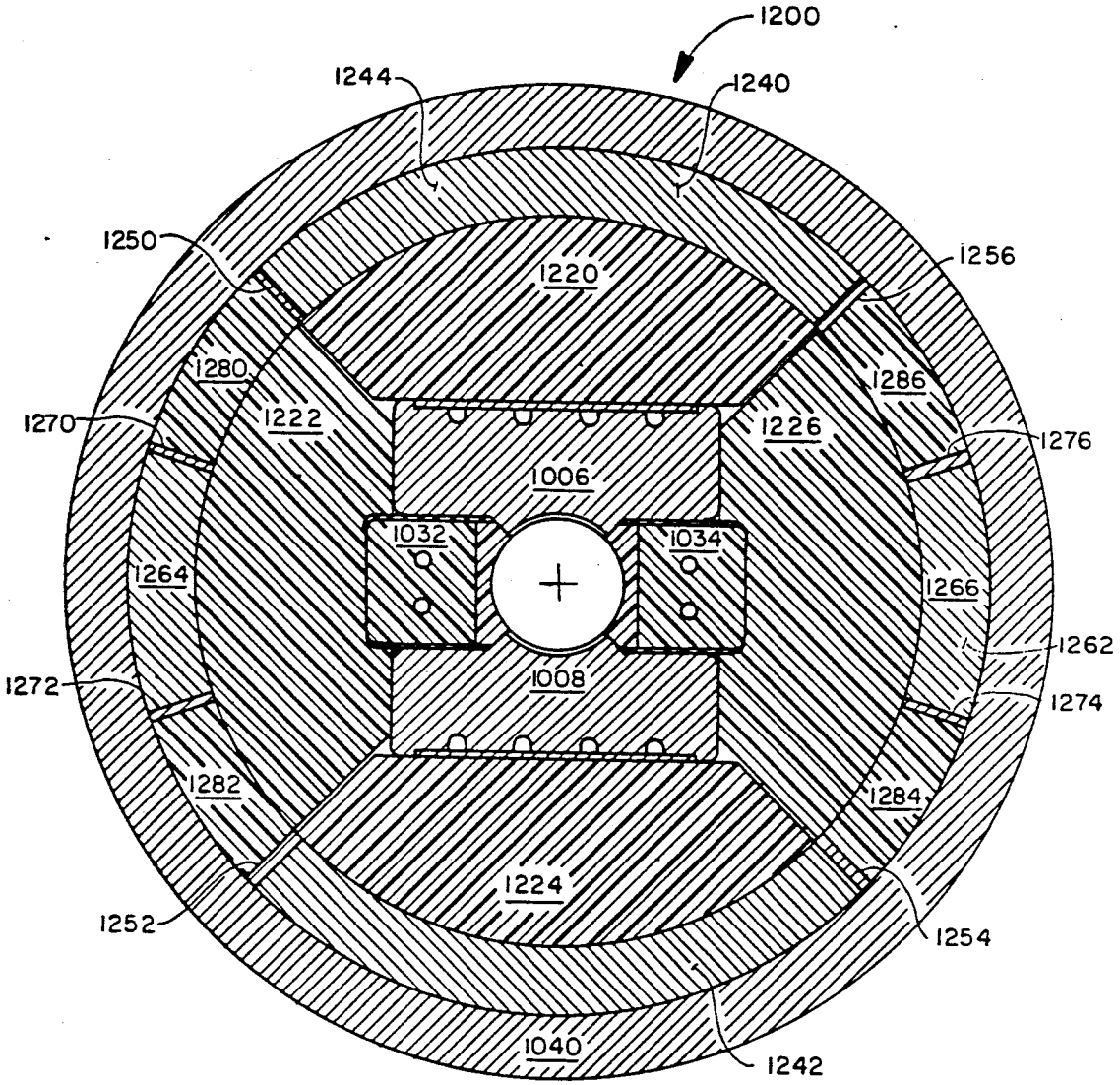
FIG. 14 is a cross-sectional elevational view of a further embodiment of a rail gun barrel, having independent, separate pressure cavities disposed about the outer surface of the rail gun body members.

Referring now to FIG. 14, an alternative rail gun barrel 1200 is shown having many components substantially identical to those of FIG. 12, except that the pressure cavities are disposed outside of the rail gun barrel body members 1220–1226. Accordingly, the internal recesses within opposed body members 1220, 1224 are not needed to accommodate pressure cavities therewithin, although such could be provided if desired.

Disposed between outer containment tube 1040 and the body members 1220–1226 are a plurality of pressure cavities which are separate and independent from one another and which are preferably aligned in quadrature about the body members. Further, the pressure cavities are preferably of unequal size so that the major pressure component is exerted along the rails 1006, 1008.

More particularly, pressure cavities 1240, 1242 diametrically oppose each other, being aligned with the rails 1006, 1008, respectively. The pressure cavity 1240 is shown filled with a pressurized solid material 1244 of the type injected into the pressure cavity as a pressurized liquid and caused to undergo a phase change to a solid state. Similarly, pressure cavity 1242 is filled with a solid pressurized material 1246. Barriers 1250–1256 are preferably provided to confine the pressurized liquid filling the pressure cavities.

Orthogonally disposed with respect to the pressure cavities, 1240, 1242 is a second pair of auxiliary cavities 1260, 1262. Solid material 1264, 1266 fills the auxiliary pressure cavities, although a liquid pressurized medium such as hydraulic oil could be used instead. Barriers 1270–1276 are disposed adjacent the pressure cavities 1260, 1262. In the Preferred Embodiment, dielectric body members 1280–1286 are interposed between adjacent pressure cavities to fill the voids therebetween. If desired, the pressure cavities could be extended to meet one another, preferably along radial lines. According to an important feature of the present invention, the pressure cavities are arranged in interleaving fashion so as to alternate about the periphery of the rail gun barrel. In the Preferred Embodiment, the pressure cavities are arranged in opposed pairs. The pairs of the pressure cavities are preferably of different sizes, and/or are operated at different pressures so that the major component of the pressure prestressing force is aligned with the rails 1006, 1008, respectively. Accordingly, the opposed pairs of pressure cavities apply an unequal prestressing force, but in each case the prestressing is circumferentially variable and is inversly proportional to the containment tube curvature which, in this preferred embodiment, has a circular cross-section but could also be elongated if desired.

It can be seen from the foregoing, that a number of different embodiments have been provided for a rail gun barrel in which circumferentially variable prestressing forces may be developed which can easily accommodate the bursting pressures developed within the bore of the rail gun and can restrain the bursting pressures developed while minimizing shear stresses at mating faces of the internal barrel components, thus minimizing the barrel radial build. In addition, the optional interlocking geometry will prevent dislocation of the barrel components which may lead to a distortion of the barrel geometry. The various prestressing mechanisms can be interchanged if desired.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A rail gun barrel having a longitudinal axis and defining an internal bore extending along said axis, comprising:

a pair of opposed, double-sided rails on opposed sides of the bore, spaced-apart along a cross-sectional major axis transverse to said longitudinal axis, said rails having adjacent sides meeting at corners;

a pair of opposed, generally T-shaped inner insulator members with stems of the T opposing one another and forming stepped edges with the heads of the T, the stems of said insulator members spaced apart and extending along a cross-sectional minor axis transverse to said major cross-sectional axis and to said longitudinal axis, said insulator members receiving at least two adjacent sides at corners of said rails, and having portions extending between said rails in interlocking engagement therewith so as to at least partly define said bore;

an outer containment tube surrounding the inner insulator members and the rails, said containment tube having a cross-section elongated along said major axis and a variable curvature so as to be more sharply rounded at the major cross-sectional axis and less sharply rounded at the minor cross-sectional axis;

internal body means disposed within said outer containment tube, surrounding said rails and said inner insulator members and engaging said rails and said inner insulator members along nonradial lines with respect to said longitudinal axis, and said internal body means having a transverse cross-section which is elongated along said major axis so as to form opposed regions of increased thickness on opposite sides of said bore, adjacent said rails; and pressure means within said internal body means for loading the outer containment tube which, because of its variable curvature with portions at said major axis more sharply rounded and portions at said minor axis less sharply rounded, translates a circumferentially variable prestress inversely proportional to its curvature with a greater prestress along said major axis and a lesser prestress along said minor axis so as to maintain intimate engagement of said rails, inner insulator members and internal body means.

2. The barrel of claim 1 wherein said rails have a transverse cross-section which is elongated in a direction generally parallel to said minor axis.

3. The barrel of claim 1 wherein said internal body means comprises at least two generally coextensive parts joined together generally at the minor axis along mating surfaces extending along the longitudinal axis of said barrel.

4. The barrel according to claim 3 wherein said pressure means has a transverse cross-section which is elongated in a direction generally parallel to the minor axis, and said pressure means is located along the major axis between two of said parts, on one side of the bore.

5. The barrel of claim 4 wherein said pressure means comprises a pressure cavity defined by said internal body means and a resilient slab in said pressure cavity, and said outer containment tube defines an aperture for a pressure source extending to contact an end of said slab.

6. The barrel of claim 1 wherein said rails have a generally rectangular transverse cross-sectional configuration.

* * * * *

UNITED STATES PATENT AND TRADEMARK OFFICE

CERTIFICATE OF CORRECTION

PATENT NO. : 5,076,135

DATED : December 31, 1991

INVENTOR(S) : Thomas W. Hurn, et al.

It is certified that error appears in the above-identified patent and that said Letters Patent is hereby corrected as shown below:

On the Title page, item [56] under the heading, "Foreign Patent Documents", under the "UK" reference, "3971", change the date from "of 1914" to read --2/1914--.

On the Title page, item [56] under the heading, "Foreign Patent Documents", under the "UK" reference, "13552", change the date from "of 1915" to --9/1915--.

In Column 4, line 8, change "cross-sectional" to read --cross-section--.

In Column 12, line 35, change "cavites" to read --cavities--.

In Column 13, line 57, change "inversly" to read --inversely--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*